US008944829B2

(12) United States Patent
Ho

(10) Patent No.: US 8,944,829 B2
(45) Date of Patent: Feb. 3, 2015

(54) CONNECTOR

(71) Applicant: Molex Incorporated, Lisle, IL (US)

(72) Inventor: Yi-Tse Ho, Taipei (TW)

(73) Assignee: Molex Incorporated, Lisle, IL (US)

( * ) Notice: Subject to any disclaimer, the term of this patent is extended or adjusted under 35 U.S.C. 154(b) by 91 days.

(21) Appl. No.: 13/868,730

(22) Filed: Apr. 23, 2013

(65) Prior Publication Data

US 2013/0323978 A1 Dec. 5, 2013

(30) Foreign Application Priority Data

Apr. 25, 2012 (TW) ..... 101207745 U

(51) Int. Cl.

| | |
|---|---|
| ***H01R 12/00*** | (2006.01) |
| ***H01R 13/04*** | (2006.01) |
| ***H01R 24/60*** | (2011.01) |
| ***H01R 12/50*** | (2011.01) |
| ***H01R 12/72*** | (2011.01) |
| *H01R 107/00* | (2006.01) |

(52) U.S. Cl.

CPC ..... *H01R 13/04* (2013.01); *H01R 24/60* (2013.01); *H01R 23/7073* (2013.01); *H01R 23/7068* (2013.01); *H01R 12/724* (2013.01); *H01R 2107/00* (2013.01)

USPC ..... 439/79

(58) Field of Classification Search

CPC ..... H01R 24/60; H01R 2107/00; H01R 23/7073; H01R 23/7068

USPC ..... 439/626, 79

See application file for complete search history.

(56) References Cited

U.S. PATENT DOCUMENTS

| | | | | |
|---|---|---|---|---|
| 5,772,474 | A | 6/1998 | Yagi et al. | |
| 6,004,160 | A | 12/1999 | Korsunsky et al. | |
| 6,109,935 | A | 8/2000 | Yang | |
| 6,135,790 | A * | 10/2000 | Huang et al. | 439/79 |
| 6,309,227 | B1 * | 10/2001 | Chen et al. | 439/79 |
| 6,371,811 | B1 | 4/2002 | Chen et al. | |
| 7,748,997 | B2 * | 7/2010 | Hamner et al. | 439/79 |
| 7,857,665 | B2 * | 12/2010 | Xiong et al. | 439/660 |
| 7,896,670 | B1 | 3/2011 | Gao et al. | |
| 2013/0157481 | A1 | 6/2013 | Soo | |

FOREIGN PATENT DOCUMENTS

| | | |
|---|---|---|
| TW | 460058 | 10/2001 |
| TW | M298251 | 9/2006 |
| TW | M420064 | 1/2012 |
| TW | M458010 | 7/2013 |

* cited by examiner

*Primary Examiner* — Neil Abrams
*Assistant Examiner* — Travis Chambers
(74) *Attorney, Agent, or Firm* — Stephen L. Sheldon

(57) ABSTRACT

A connector includes a housing, a plurality of first terminals, a plurality of second terminals and a terminal positioning seat. The housing has an upright base and a tongue plate. Each first terminal has a first fixed portion, a first extension portion and a first tail portion. Each second terminal has a second fixed portion, a second extension portion and a second tail portion. The first and second extension portions are bent and extend laterally, and are arranged as two rows in a front-rear direction behind an upright portion of the housing. The terminal positioning seat is assembled with the base of the housing, and has a base portion and an assembly portion extending upwardly from the base portion. The assembly portion has a partition plate, and the partition plate is positioned between the first extension portions and the second extension portions.

20 Claims, 15 Drawing Sheets

CONNECTOR

RELATED APPLICATIONS

This application claims priority to Taiwanese Application No. 101207745, filed Apr. 25, 2012, which is incorporated herein by reference in its entirety.

TECHNICAL FIELD

The technical field relates to an electrical connector, particularly to an upright type electrical connector and an electrical connector assembly.

BACKGROUND

Referring to FIG. 1, Taiwanese utility patent No. TWM420064 discloses an upright type connector with USB 3.0 specification, which comprises a cage 91, a housing 92, a tongue plate 93, a plurality of first connection terminals 94, a plurality of second connection terminals 95 and a positioning plate 96. The tongue plate 93 is assembled to the housing 92, the first connection terminals 94 and the second connection terminals 95 are respectively fixedly provided at two sides of the tongue plate 93 and are arranged from top to bottom, leg portions 941 of the first connection terminals 94 and leg portions 951 of the second connection terminals 95 are respectively arranged at the two sides along a mating direction X, which greatly increases an overall length of the connector.

In addition, the positioning plate 96 is engaged with the housing 92, and has a plurality of through holes 961 into which the leg portions 941, 951 is inserted for positioning the leg portions 941, 951. As the positioning plate 96 has a thin structure, an effect of positioning the terminals is relatively limited.

SUMMARY OF THE INVENTION

Therefore, an electrical connector of one embodiment comprises an housing, a plurality of first terminals, a plurality of second terminals and a terminal positioning seat. The housing has a base and a tongue plate. The base has an upright portion, and the upright portion has a front end face and a rear end face opposite to the front end face. The tongue plate vertically extends forwardly from the front end face of the upright portion and has a first plate surface and a second plate surface at opposite two sides. The first terminals each have a first fixed portion, a first extension portion and a first tail portion. The first fixed portions are fixed to the housing, are adjacent to the first plate surface and are arranged from top to bottom. The first extension portion of each first terminal is bent and extends laterally from a rear end of the first fixed portion, and the first tail portion extends from a distal end of the first extension portion. The first extension portions are arranged at the rear end face of the upright portion, and the first tail portions are arranged side by side along a left-right direction. The second terminals each have a second fixed portion, a second extension portion and a second tail portion. The second fixed portions are fixed to the housing, are adjacent to the second plate surface and are arranged from top to bottom. The second extension portion of each second terminal is bent and extends laterally from a rear end of the second fixed portion, and the second tail portion extends from a distal end of the second extension portion. The second extension portions are arranged behind the first extension portions, and the second tail portions are arranged side by side along the right-left direction. The terminal positioning seat is assembled with the base of the housing and has a base portion and an assembly portion extending upwardly from the base portion. The assembly portion has a partition plate, the partition plate is positioned between the first extension portions and the second extension portions.

The electrical connector assembly of one embodiment comprises at least two above described electrical connectors connected side by side, and terminal positioning seats of the two adjacent electrical connectors are integrally connected together.

DETAILED DESCRIPTION OF THE PREFERRED EMBODIMENTS

Figure 1:
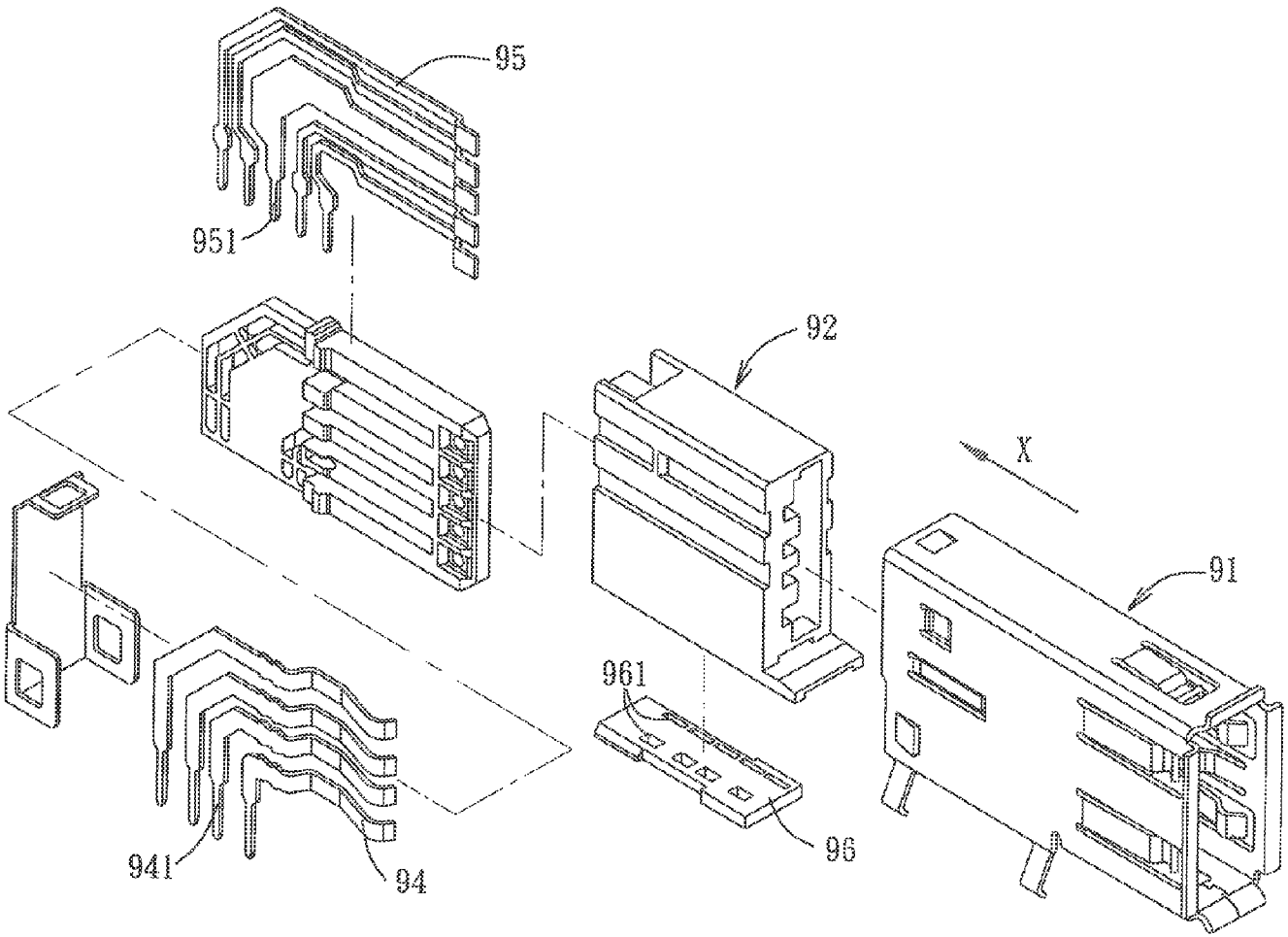
FIG. 1 is an exploded perspective view illustrating an electrical connector in the prior art.

The foregoing and other technical contents, features and effects of the embodiments will be apparent through the following detailed description for three embodiments in combination with the drawings. Before the embodiments are described in details, it should be noted that like elements are indicated by like reference numerals in the following description.

While not intended to be limiting, one potential object of the disclosure is to describe an electrical connector capable of shortening an overall length and improving an effect of positioning terminals. Another potential object of the disclosure is to describe how to provide an electrical connector assembly by assembling a plurality of the electrical connectors described as above together. The effects of the embodiments are that the first extension portions and the second extension portions are bent and extend laterally to be arranged as two rows in the front-rear direction behind the upright portion of the housing, so as to greatly shorten the overall length of the electrical connector in the front-rear direction. In addition, by that the partition plate partitions the first extension portions and the second extension portions, the terminal positioning seat can completely and reliably cover and position each first extension portion, each first tail portion, each second extension portion and each second tail portion.

Figure 3:
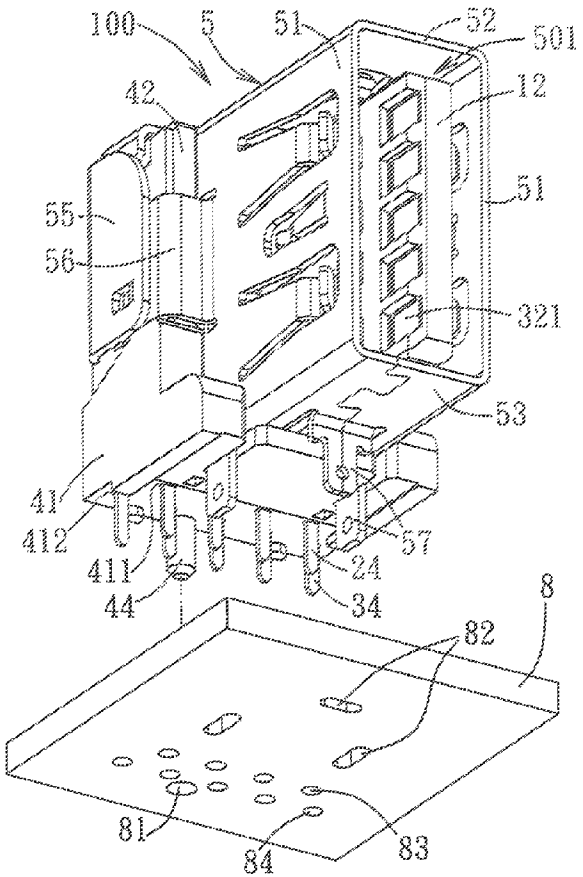
FIG. 3 is an exploded perspective view of FIG. 2 illustrating a corresponding relationship between the first embodiment and the circuit board.
Figure 2:
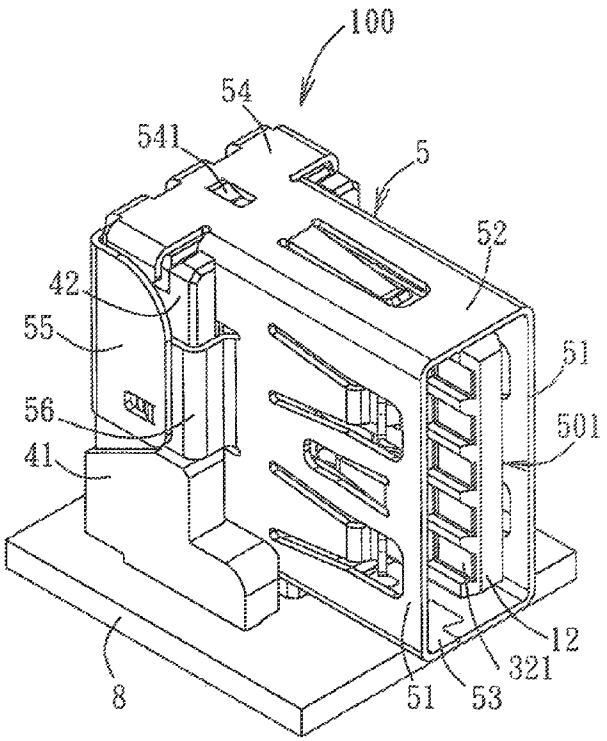
FIG. 2 is a perspective view illustrating a first embodiment of an electrical connector which is mounted to a circuit board.

Referring to FIG. 2 and FIG. 3, a first embodiment of an electrical connector 100 is suitable to be mounted on a circuit board 8. Referring to FIGS. 4-7, the electrical connector 100 comprises a housing 1, a plurality of first terminals 2, a plurality of second terminals 3, a terminal positioning seat 4 and a cage 5.

Figure 10:
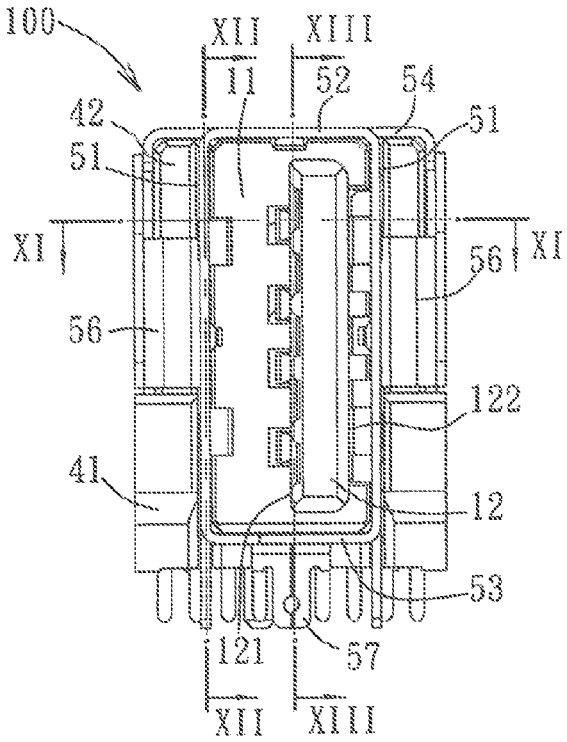
FIG. 10 is a front view of the first embodiment.
Figure 11:
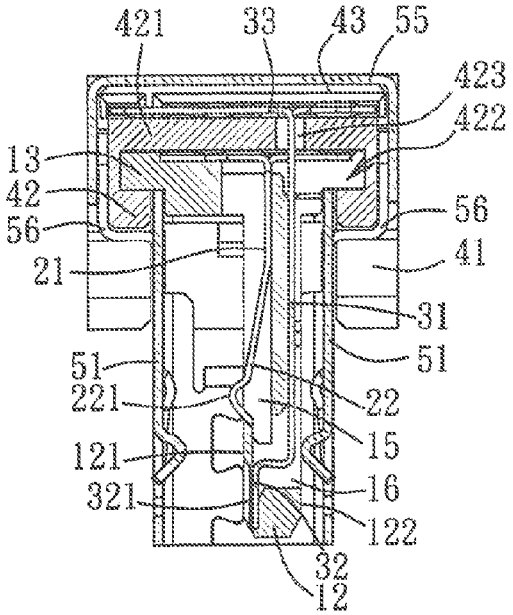
FIG. 11 is a cross-sectional view taken along a line XI-XI of FIG. 10.

The housing 1 has a base 11 and a tongue plate 12, the base 11 has an upright portion 13 and a top plate portion 14 connected to a top end of the upright portion 13 and extending rearwardly. The upright portion 13 has a front end face 131 and a rear end face 132 opposite to the front end face 131, the tongue plate 12 vertically extends forwardly from the front end face 131 of the upright portion 13 and has a first plate surface 121 and a second plate surface 122 at opposite two sides. The housing 1 further has a plurality of first terminal grooves 15 respectively receiving the first terminals 2 and a plurality of second terminal grooves 16 respectively receiving the second terminals 3, each first terminal groove 15 penetrates the upright portion 13 and extends forwardly to the first plate surface 121 of the tongue plate 12, each second terminal groove 16 penetrates the upright portion 13 and extends forwardly to the second plate surface 122 of the tongue plate 12 and penetrates the tongue plate 12 at a front end thereof and extends to the first plate surface 121 (in combination with referring to FIG. 10 and FIG. 11). The first terminal grooves 15 are arranged from top to bottom and the second terminal grooves 16 are also arranged from top to bottom.

Each first terminal 2 has a first fixed portion 21, a resilient contact portion 22, a first extension portion 23 and a first tail portion 24. The first fixed portion 21 is fixed to the housing 1 via protrusions 211 at two sides and is adjacent to the first plate surface 121, the resilient contact portion 22 extends from a front end of the first fixed portion 21 and has a first contact face 221 exposed from the first plate surface 121, the first extension portion 23 is bent and extends laterally from a rear end of the first fixed portion 21, and the first tail portion 24 extends downwardly from a distal end of the first extension portion 23. The first fixed portions 21 and the resilient contact portions 22 are respectively received in the first terminal grooves 15 and arranged from top to bottom. The first extension portions 23 are arranged at the rear end face 132 of the upright portion 13, the first extension portion 23 of the first terminal 2 at the lowermost is bent toward the same direction as the second plate surface 122 faces and then extends downwardly, the first extension portions 23 of the other first terminals 2 are bent toward the same direction as the first plate surface 121 faces and then extend downwardly. The first tail portions 24 extend downwardly respectively from the first extension portions 23 and are arranged side by side along a left-right direction. Furthermore, the upright portion 13 also has a plurality of limiting grooves 133 positioned in the rear end face 132 for respectively receiving the first extension portions 23 to position the first extension portions 23, so as to avoid swaying of the first extension portions 23.

Each second terminal 3 has a second fixed portion 31, a second contact portion 32, a second extension portion 33 and a second tail portion 34. The second fixed portion 31 is fixed to the housing 1 via protrusions 311 at two sides and is adjacent to the second plate surface 122, the second contact portion 32 extends from a front end of the second fixed portion 31 and has a second contact face 321 exposed from the first plate surface 121, the second extension portion 33 is bent and extends laterally from a rear end of the second fixed portion 31, and the second tail portion 34 extends downwardly from a distal end of the second extension portion 33. The second fixed portions 31 and the second contact portions 32 are respectively received in the corresponding second terminal grooves 16 and are arranged from top to bottom. The second extension portions 33 are arranged behind the first extension portions 23, and the second tail portions 34 are arranged side by side along the left-right direction.

In the embodiment, the first terminals 2 are provided as four total in number for transmitting a signal conforming to USB2.0 transmission specification; the second terminals 3 are provided as five total in number and are cooperative with the first terminals 2, for transmitting a signal conforming to USB3.0 transmission specification. The second terminals 3 are numbered as I, II, III, IV and V from top to bottom. The second extension portion 33 of the second terminal 3 numbered as V is bent and extends in the same direction as the second plate surface 122 faces and then extends downwardly, the second extension portions 33 of the other second terminals 3 are bent and extend in the same direction as the first plate surface faces 121 and then extend downwardly. The first extension portion 23 of the first terminal 2 at the lowermost is bent and extends in the same direction as the second plate surface 122 faces to pass through between the two second terminals 3 numbered as IV and V and then extends downwardly. Namely, only the first extension portion 23 of the first terminal 2 at the lowermost and the second extension portion 33 of the second terminal 3 at the lowermost are bent toward a direction opposite to a direction toward which the rest of the first extension portions 23 and the second extension portions 33 are bent, and the first extension portion 23 of the first terminal 2 at the lowermost further passes through between the two adjacent second terminals 3 at the lowermost, by which, not only the first extension portions 23 together with the first tail portions 24 can be arranged side by side in the left-right direction, and the second extension portions 33 together with the second tail portions 34 also can be arranged side by side in the left-right direction, and the first extension portions 23 together with the first tail portions 24 and the second extension portions 33 together with the second tail portions 34 are arranged as two rows in a front-rear direction, so as to shorten lengths of the first terminals 2 and the second terminals 3 in the front-rear direction, and also effectively utilize the space. Furthermore, an overall length of the electrical connector 100 in the front-rear direction can be shortened.

In addition, the second terminals 3 numbered as I and II are provided as a pair and the second terminals 3 numbered as IV and V are provided as another pair for transmitting a high-frequency signal, for example different pairs signal, lengths of parts of the same pair of the second terminals 3 used for transmitting the signal are the same, namely, a length from a contact position between the second contact portion 32 of the second terminal 3 and a terminal of a mating plug connector to a soldering point of the second tail portion 34 is the same, that is the lengths from the second contact portions 32 of the same pair of second terminals 3 to the second tail portions 34 are the same. In the embodiment, the second extension portions 33 of the second terminals 3 numbered as II and V each have a serpentine segment 331, the serpentine segment 331 is bent irregularly to increase a length thereof, so as to allow the lengths of the second extension portions 33 of the second terminals 3 numbered as I and II to be the same and allow the lengths of the second extension portions 33 of the second terminals 3 numbered as IV and V to be the same. In addition, as lengths of the second fixed portions 31 of all the second terminals 3 are the same, lengths of the second contact portions 32 of all the second terminals 3 are the same and lengths of the second tail portions 34 of all the second terminals 3 are also the same, lengths of the same pair of the second terminals 3 numbered as I and II are the same, lengths of the same pair of the second terminals 3 numbered as IV and V are the same, by which, the pair of the terminals for transmitting high-frequency signal have the same lengths to reduce signal skew, so as to meet requirements for high-frequency signal transmission. It should be noted that as used herein, the same is understood to be substantially the same as it is expected that tolerances inherent in manufacturing, for example, may cause terminals to have slightly different lengths even though they are supposed to have the same length by design.

Figure 4:
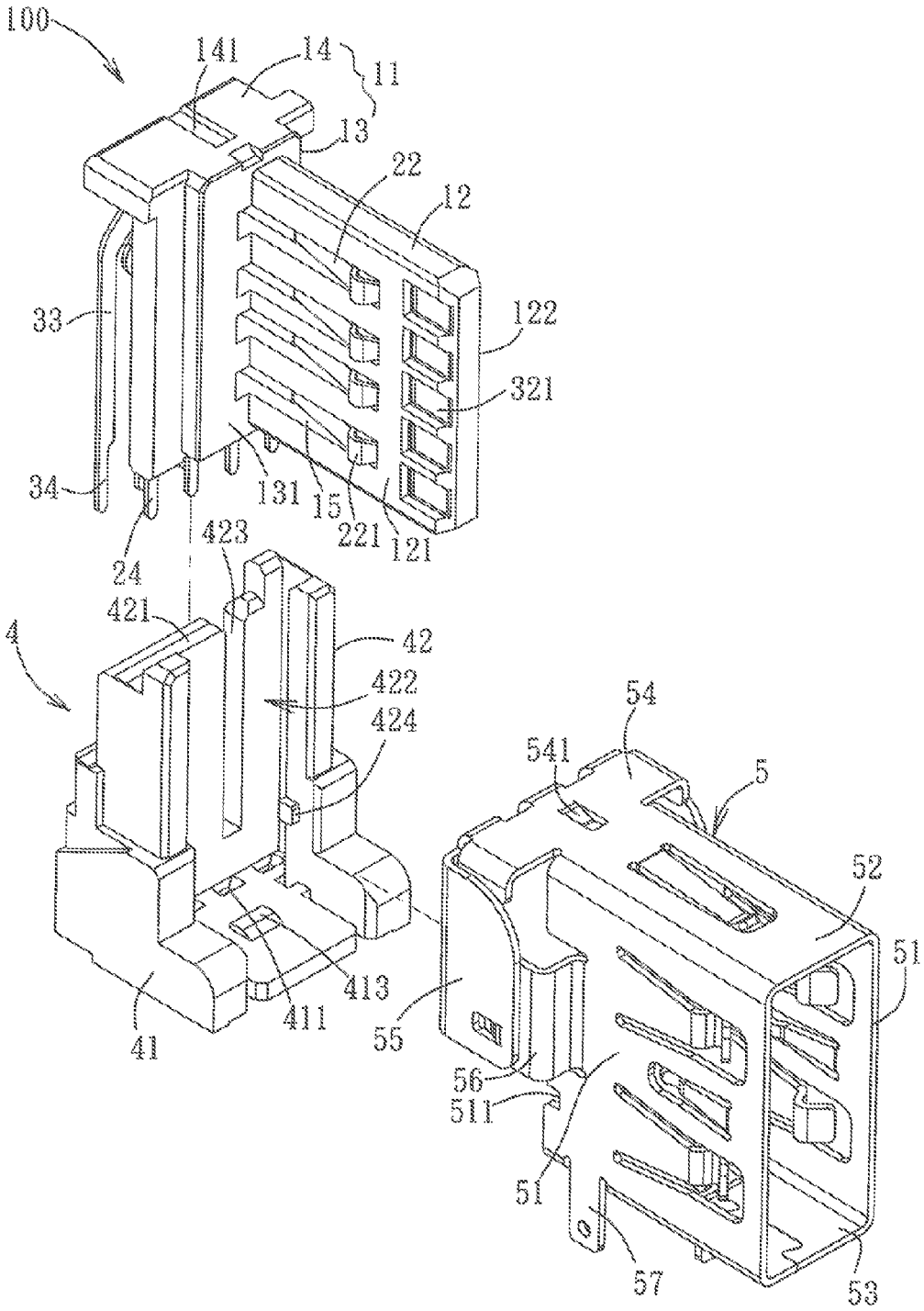
FIG. 4 is an exploded perspective view illustrating the first embodiment.
Figure 9:
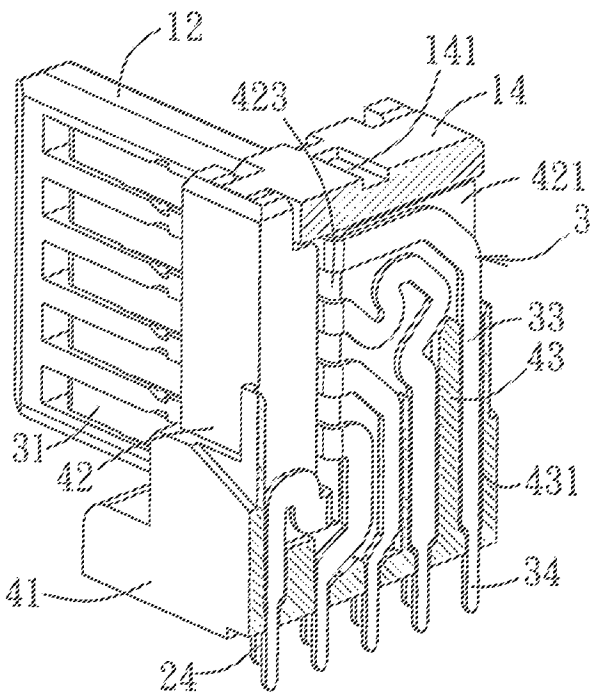
FIG. 9 is a view similar to FIG. 8 illustrating positioning relationship of the terminal positioning seat and the terminals, in which a rear side portion of a top plate portion of the housing and a part of a rear wall of the terminal positioning seat are cut away.
Figure 8:
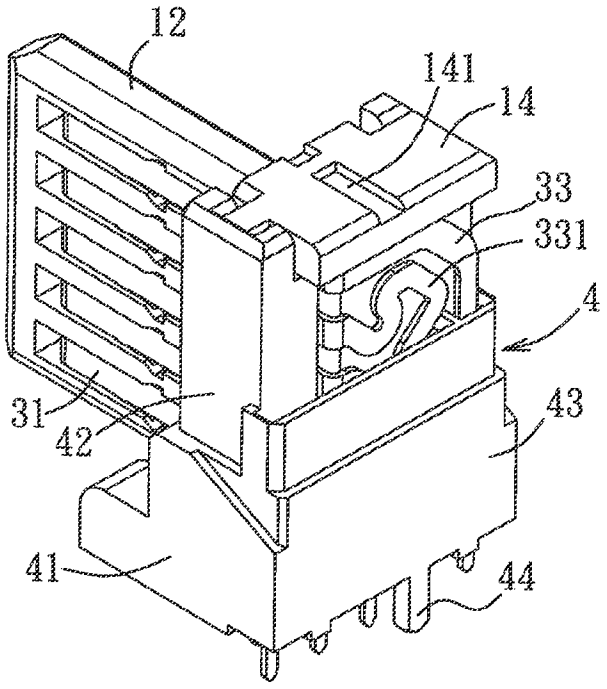
FIG. 8 a perspective view illustrating an assembling relationship between a terminal positioning seat and the housing in the first embodiment.
Figure 12:
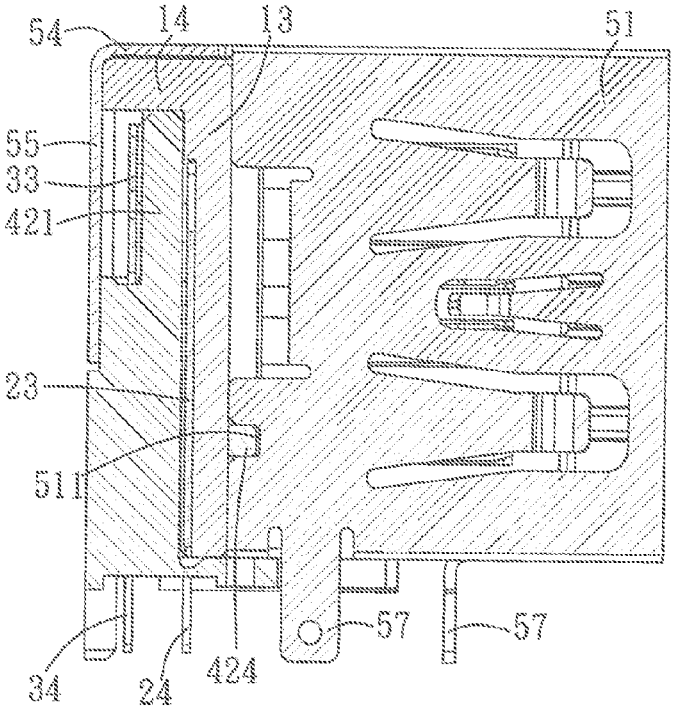
FIG. 12 is a cross-sectional view taken along a line XII-XII of FIG. 10.
Figure 13:
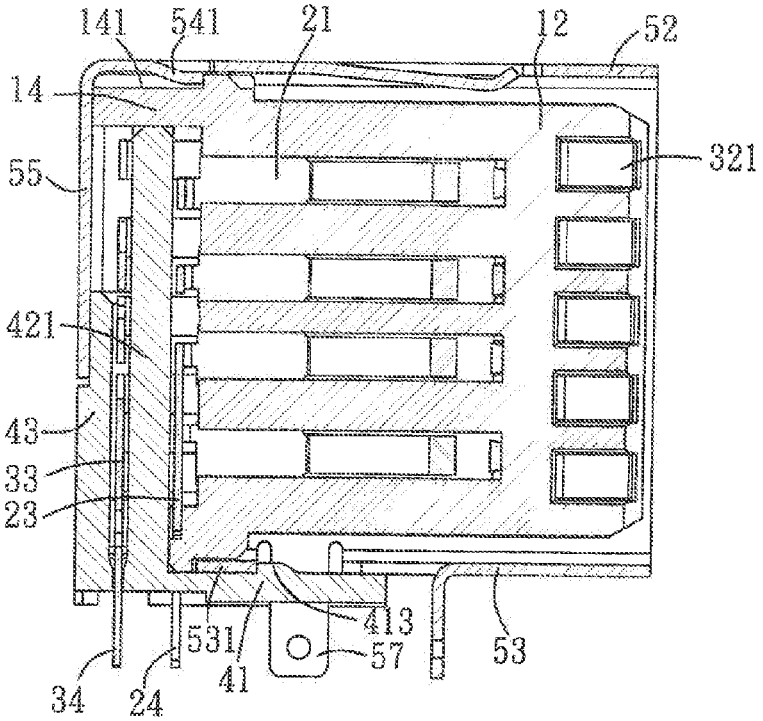
FIG. 13 is a cross-sectional view taken along a line XIII-XIII of FIG. 10.
Figure 14:
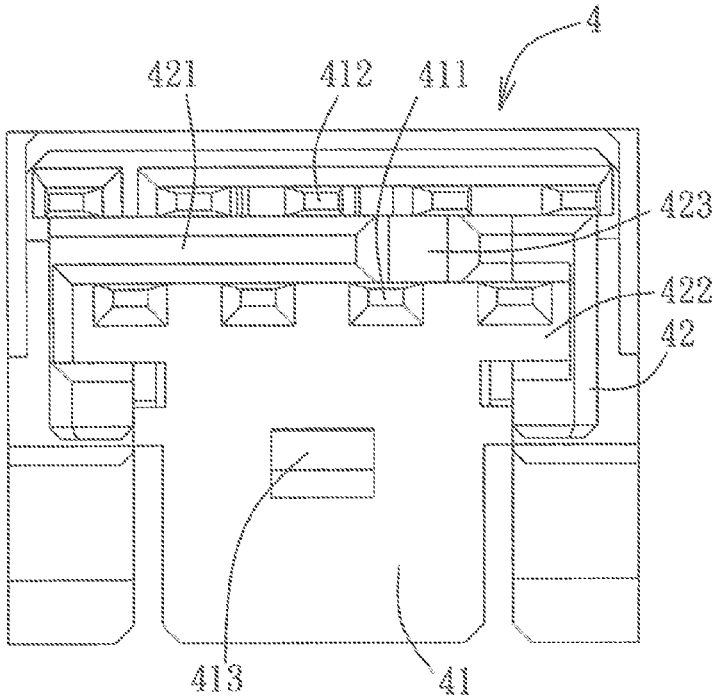
FIG. 14 is a top view illustrating the terminal positioning seat.
Figure 15:
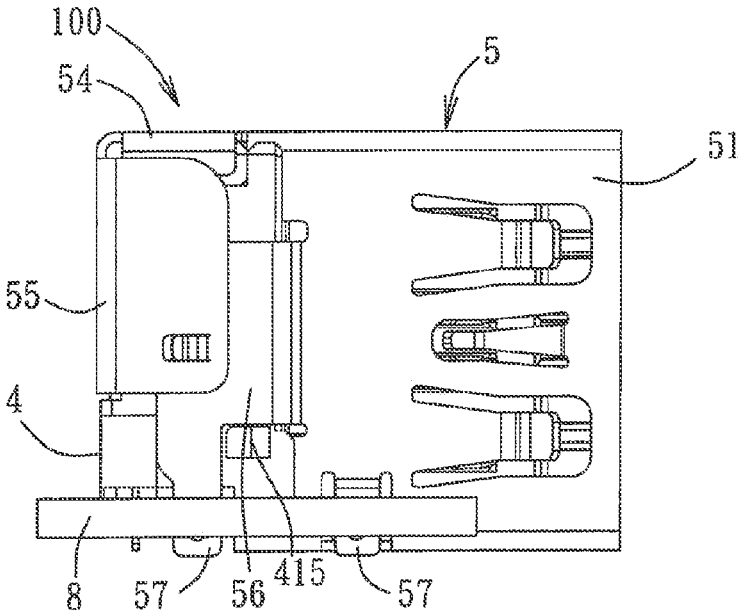
FIG. 15 is a side view illustrating a second embodiment of the electrical connector which is mounted to a circuit board.
Figure 16:
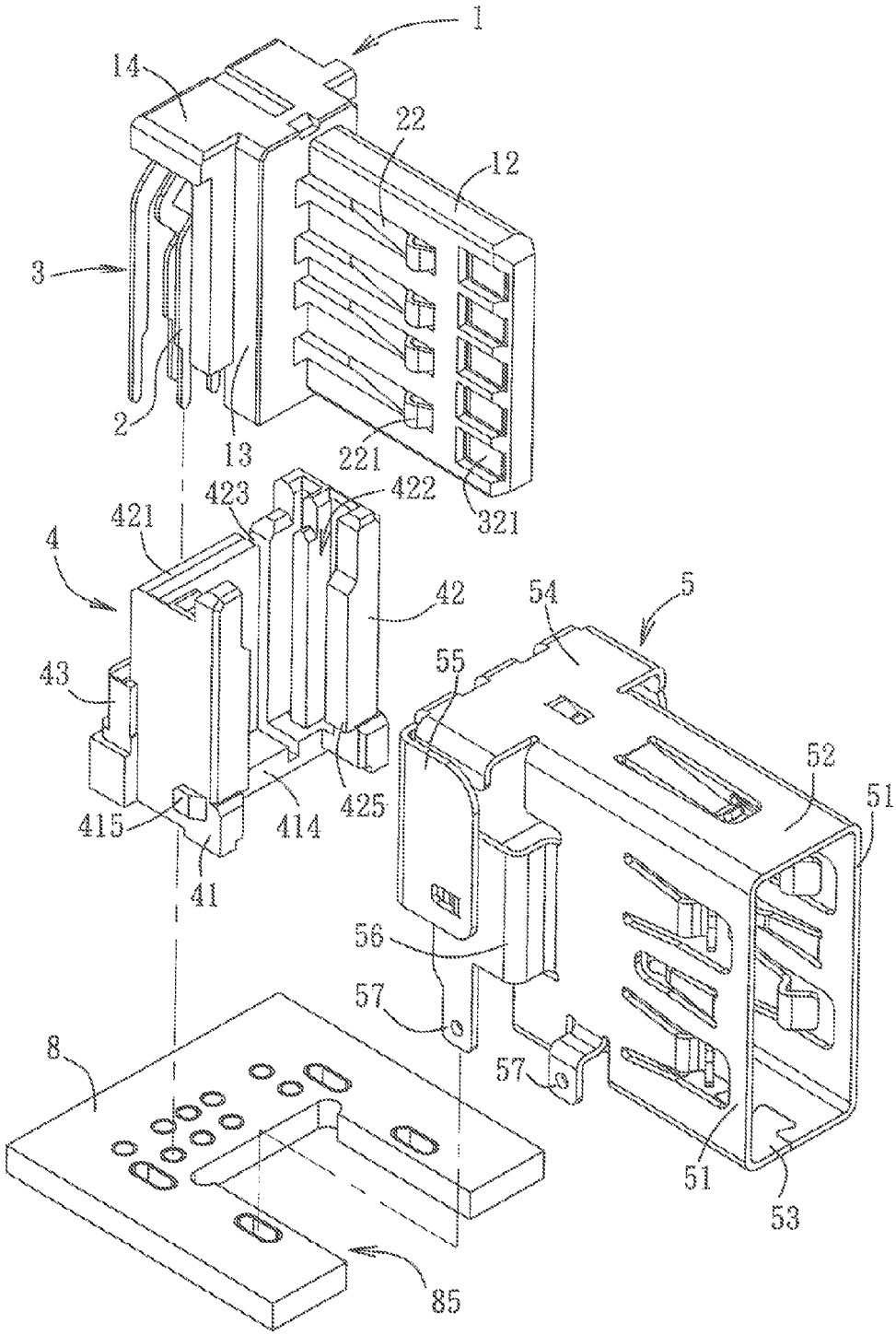
FIG. 16 is an exploded perspective view illustrating the second embodiment and a corresponding relationship between the second embodiment and the circuit board.
Figure 17:
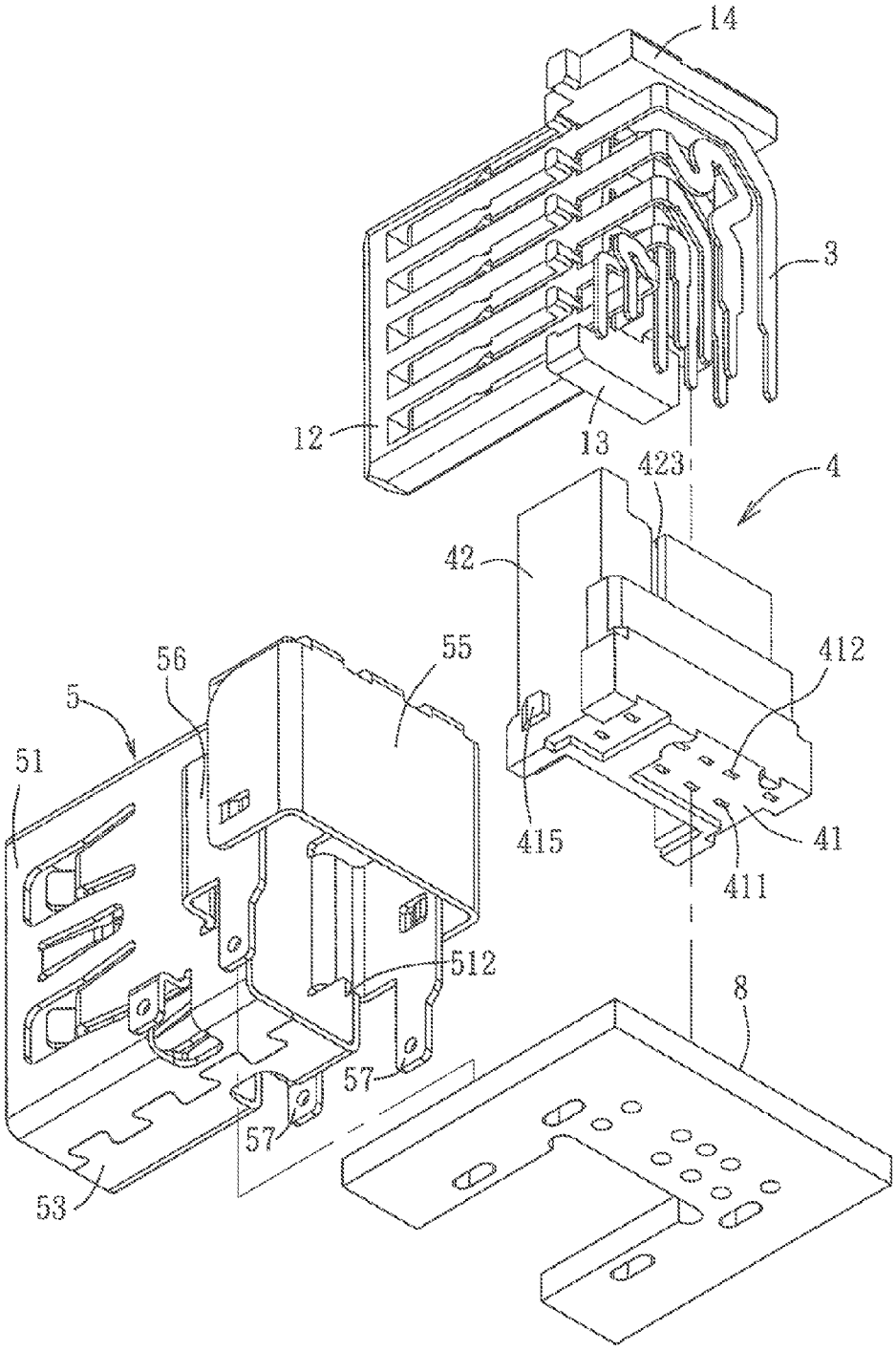
FIG. 17 is a view of FIG. 16 from another angle.
Figure 19:
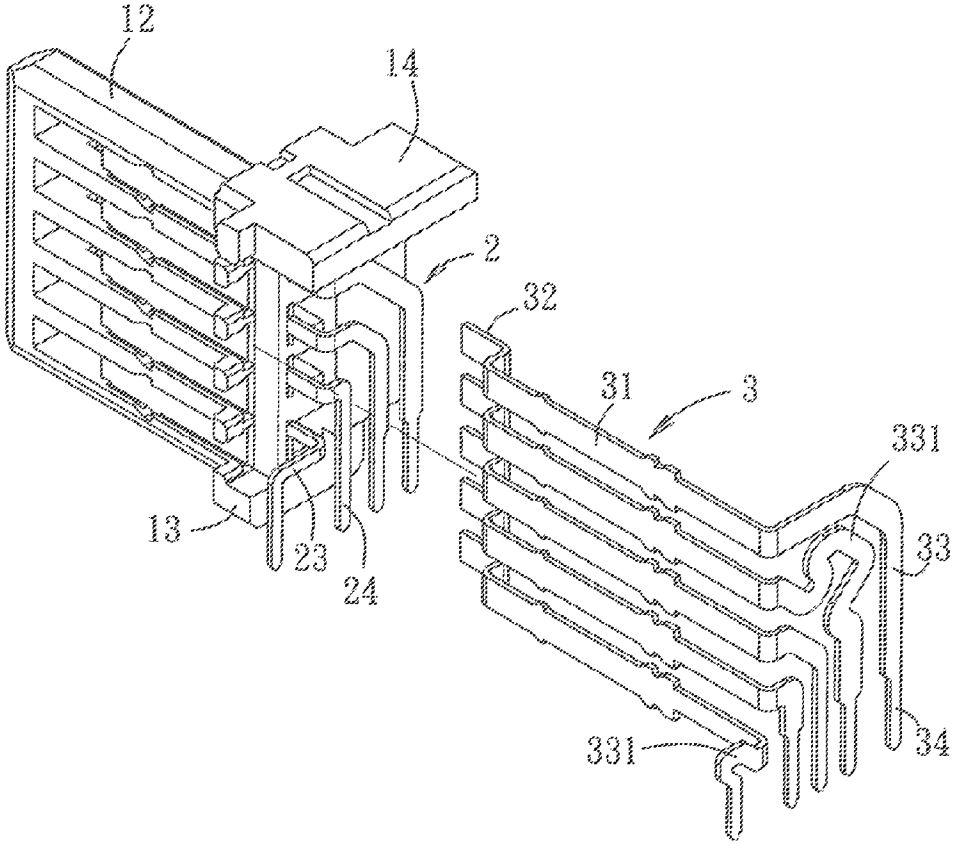
FIG. 19 is an exploded perspective view illustrating extension portions and tail portions of the first terminals and the second terminals in the second embodiment.
Figure 18:
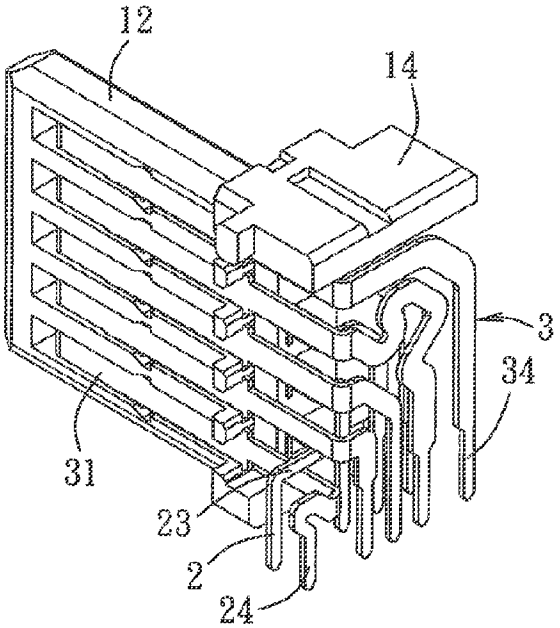
FIG. 18 is a perspective view illustrating an assembling relationship among an housing and a plurality of first terminals and a plurality of second terminals in the second embodiment.
Figure 20:
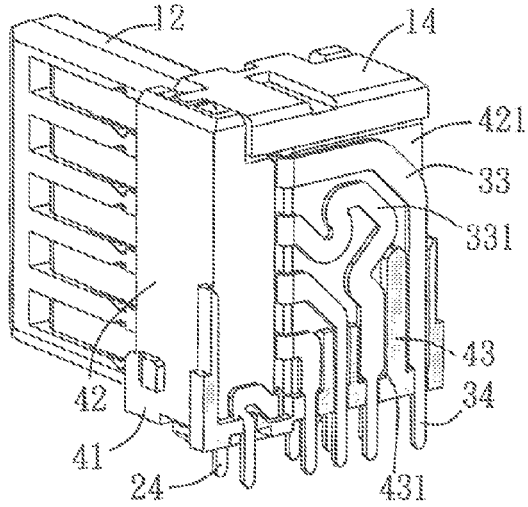
FIG. 20 is a view similarly to FIG. 9 illustrating a positioning relationship between a terminal positioning seat and the terminals in the second embodiment.

Referring to FIG. 4, FIG. 8 and FIG. 9, the terminal positioning seat 4 is assembled with the base 11 of the housing 1, and has a base portion 41 and an assembly portion 42 extending upwardly from the base portion 41. The assembly portion 42 has a partition plate 421 and defines a mounting groove 422 to be engaged with and receive the upright portion 13 of the base 11 (in combination with referring to FIG. 11), the partition plate 421 and the rear end face 132 of the upright portion 13 are opposite and spaced apart (in combination with referring to FIG. 12). The partition plate 421 is positioned between the first extension portions 23 and the second extension portions 33 (in combination with referring to FIG. 13), and has a slit 423 extending along an up-down direction so as to allow the second extension portions 33 to pass through the partition plate 421. In addition, in combination with referring to FIG. 3 and FIG. 14, the base portion 41 of the terminal positioning seat 4 has a plurality of first through holes 411 and a plurality of second through holes 412, the first through holes 411 are positioned in front of the partition plate 421 for correspondingly inserting and positioning the first tail portions 24, the second through holes 412 are positioned behind the partition plate 421 for correspondingly inserting and positioning the second tail portions 34. In addition, referring to FIG. 8 and FIG. 9 again, the terminal positioning seat 4 further has a rear wall 43 behind the partition plate 421, and the rear wall 43 defines a plurality of limiting grooves 431 to respectively receive the second extension portions 33 so as to position the second extension portions 33, and avoid swaying of the second extension portions 33. By that the partition plate 421 partitions the first extension portions 23 and the second extension portions 33, the terminal positioning seat 4 can completely and reliably cover and position each first extension portion 23, each first tail portion 24, each second extension portion 33 and each second tail portion 34.

Figure 5:
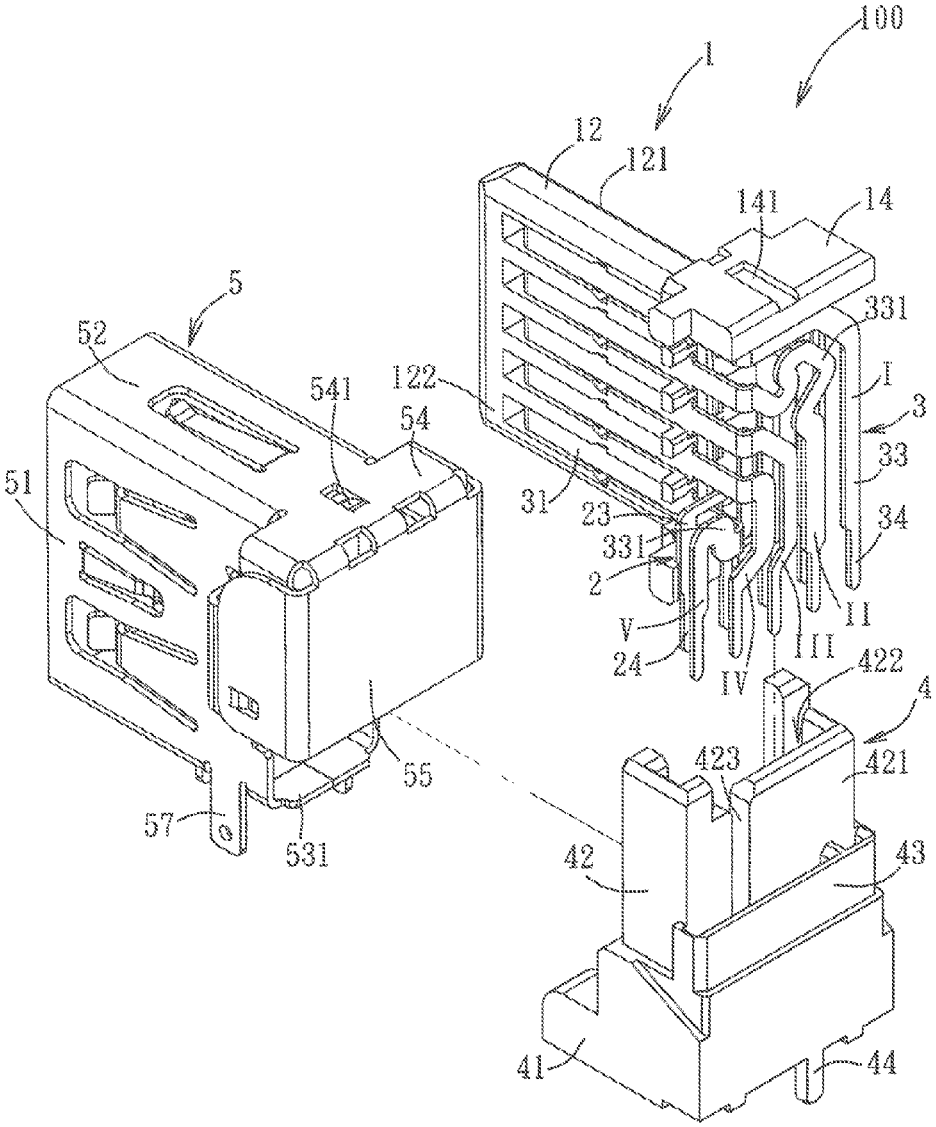
FIG. 5 is a view of FIG. 4 from another angle.
Figure 6:
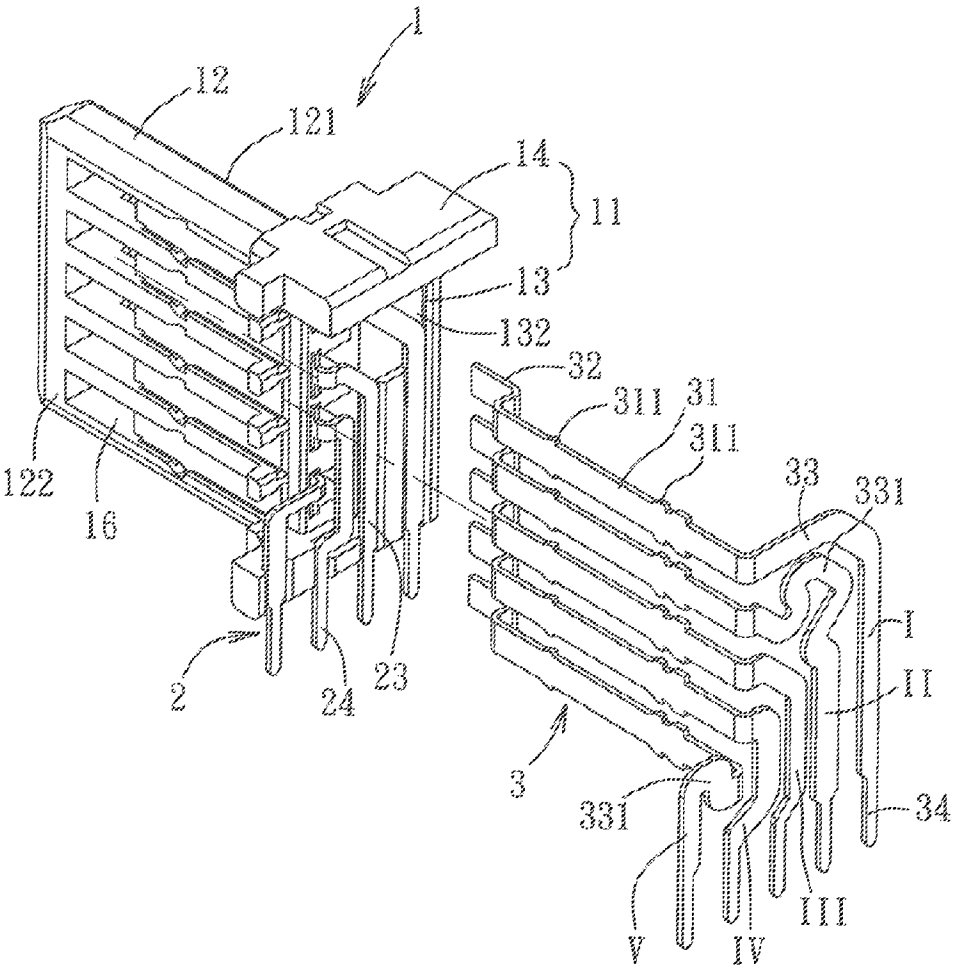
FIG. 6 is an exploded perspective view illustrating an assembling relationship among an housing and a plurality of first terminals and a plurality of second terminals in the first embodiment.
Figure 7:
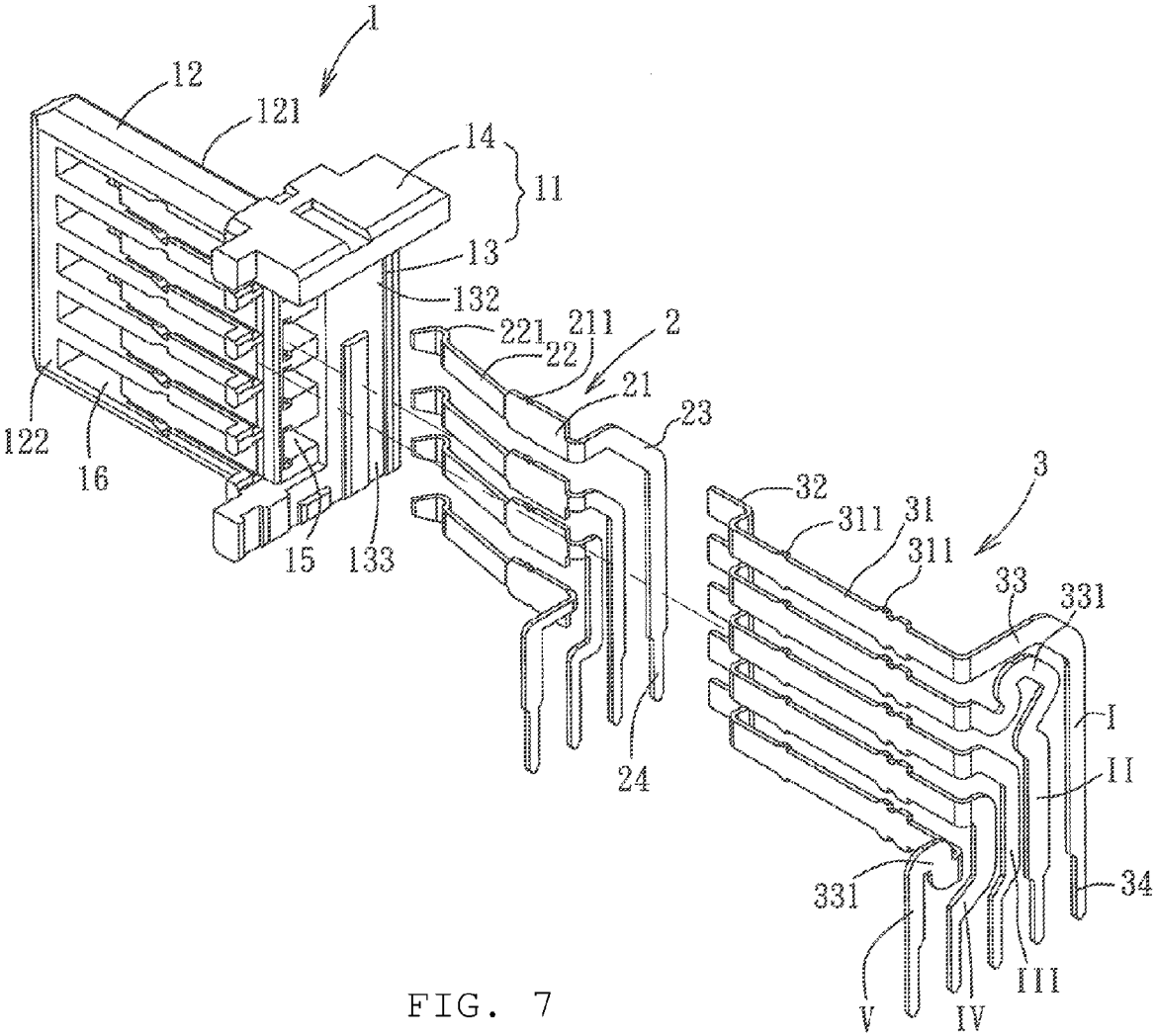
FIG. 7 is a further exploded view of FIG. 6 illustrating the first terminals.

Referring to FIG. 3, FIG. 4 and FIG. 5, the cage 5 surrounds the tongue plate 12 to define a mating space 501, and a part of the cage 5 is engaged with the base 11, and a part of the cage 5 is engaged with the terminal positioning seat 4. Specifically, the cage 5 has two upright side plates 51, a top plate 52, a bottom plate 53, an upper covering plate 54 and an upright covering plate 55. The upright side plates 51 respectively face the first plate surface 121 and the second plate surface 122 of the tongue plate 12, and respectively have cutouts 511 recessed forwardly from rear ends, and the assembly portion 42 of the terminal positioning seat 4 further has two protruding blocks 424 oppositely protruding, the protruding blocks 424 are respectively matched with and received in the cutouts 511, so as to relatively position the cage 5 and the terminal positioning seat 4 in the up-down direction. The top plate 52 is connected to upper ends of the upright side plates 51. The bottom plate 53 is connected to lower ends of the upright side plates 51. The upper covering plate 54 is connected to a rear end of the top plate 52 and covers the top plate portion 14 (in combination with referring to FIG. 12), and has a tab 541 extending obliquely downwardly to be correspondingly received in a clamping groove 141 of the top plate portion 14 (in combination with referring to FIG. 13). Furthermore, the base portion 41 further has a stopper 413, the bottom plate 53 of the cage 5 has a latch portion 531 correspondingly latching at a rear side of the stopper 413, so as to relatively position the cage 5 and the terminal positioning seat 4 in the front-rear direction. The upright covering plate 55 is connected to a rear end of the upper covering plate 54 and partially covers left and right sides and a rear side of the terminal positioning seat 4 (in combination with referring to FIG. 11). In addition, the cage 5 further has two extending sheets 56 respectively extending from a rear end of the upright side plate 51, the extending sheets 56 is engaged with and latched with the upright covering plate 55, to together cover the terminal positioning seat 4 from front, rear, left and right sides.

Furthermore, referring to FIG. 2 and FIG. 3, the terminal positioning seat 4 further has a protruding post 44 protruding downwardly from the base portion 41 to insert into a corresponding through hole 81 of the circuit board 8 in an interference fit. The cage 5 further has a plurality of insert pieces 57 protruding downwardly from the bottom plate 53 to insert into corresponding through holes 82 of the circuit board 8 and be soldered and fixed to the circuit board 8. The first tail portions 24 and the second tail portions 34 respectively insert into corresponding through holes 83, 84 of the circuit board 8, and are soldered and fixed to the circuit board 8.

Referring to FIGS. 15-20, an electrical connector 100 of a second embodiment is suitable to be mounted on a circuit board 8 having a cutout 85 in a sinking manner. The structure of the electrical connector 100 in the second embodiment is substantially the same as that in the first embodiment, and is adjusted just for mounting on the circuit board 8 as the sinking manner, and the adjustments include that the insert pieces 57 of the cage 5 are adjusted as two pairs respectively arranged at two sides, and spacings between the first tail portions 24 of the first terminals 2 are different and spacings between the second tail portions 34 of the second terminals 3 are different. In addition, referring to FIG. 16 and FIG. 17, in the second embodiment, the base portion 41 of the terminal positioning seat 4 further has a cutout 414 recessed rearwardly from a front end, and two stoppers 415 oppositely protruding respectively from two outer sides of the base portion 41, and the cutout 414 allows the assembly portion 42 to form a pair of flanges 425 oppositely protruding above the cutout 414. And rear ends of the upright side plates 51 of the cage 5 respectively form step portions 512, the step portions 512 respectively correspond to the flanges 425, and each step portion 512 abuts against a front side and a bottom side of the corresponding flange 425. By that each step portion 512 abuts against the rear side of the corresponding flange 425, and the upper covering plate 54 abuts against the top plate portion 14, the cage 5 and the terminal positioning seat 4 are relatively positioned in the up-down direction. In combination with referring to FIG. 15, a pair of insert pieces 57 in the rear respectively abut against rear sides of the corresponding stoppers 415. By that each step portion 512 abuts against the front side of the corresponding flange 425 and the insert piece 57 abuts against the rear side of the corresponding stopper 415, the cage 5 and the terminal positioning seat 4 are relatively positioned in the front-rear direction.

Figure 21:
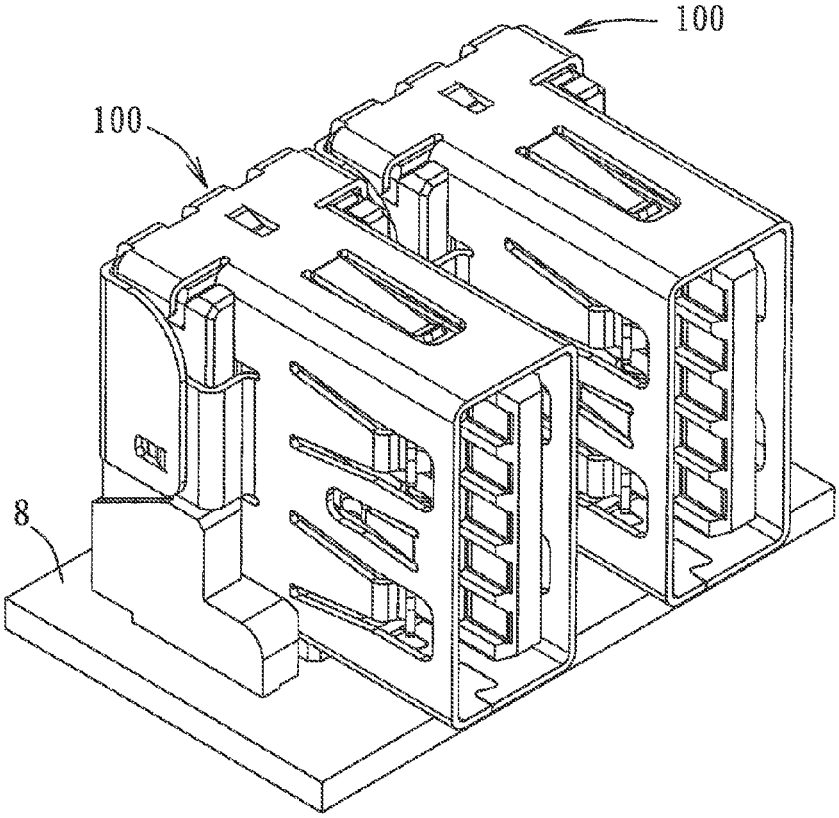
FIG. 21 is a perspective view illustrating an embodiment of an electrical connector assembly which is mounted to the circuit board.
Figure 22:
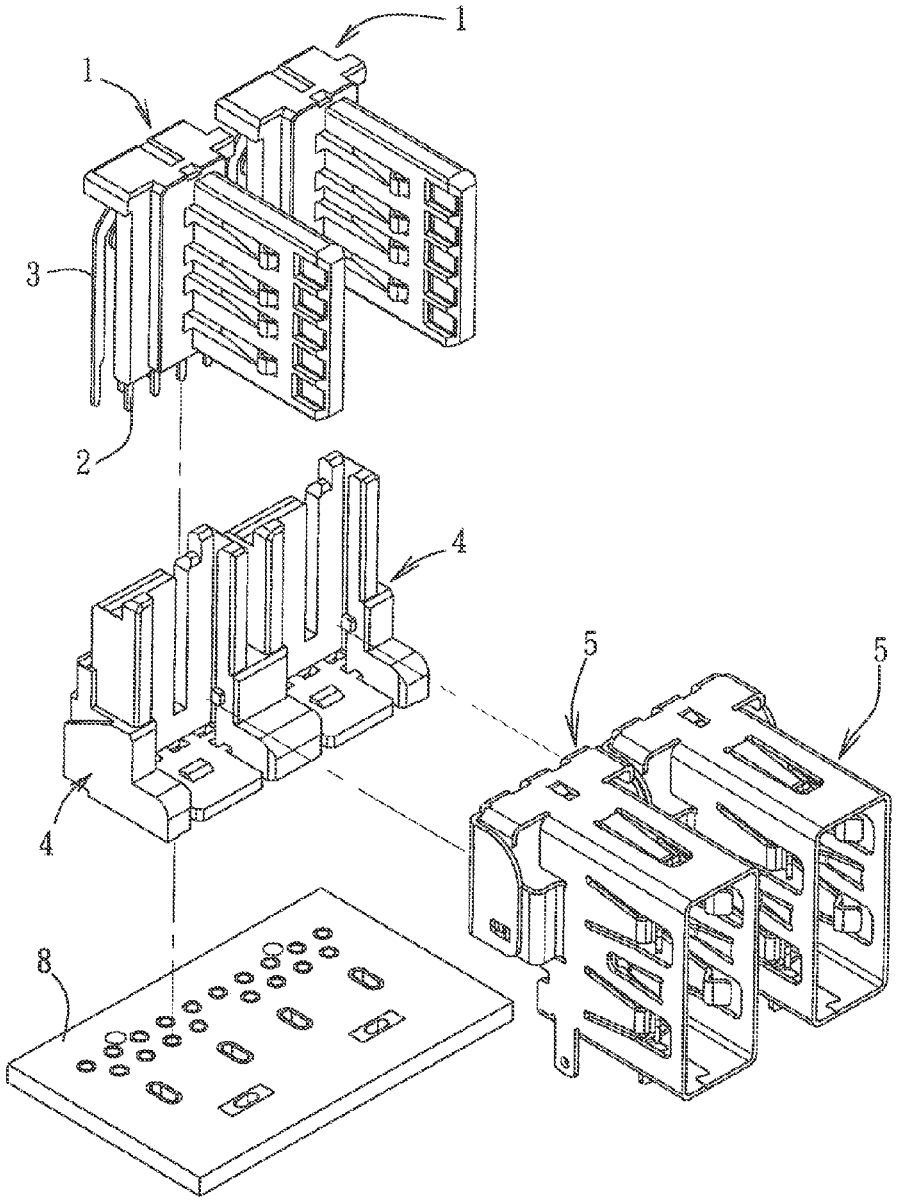
FIG. 22 is an exploded perspective view illustrating two adjacent terminal positioning seats which are integrally connected together in the embodiment.

Referring to FIG. 21 and FIG. 22, an electrical connector assembly of an embodiment comprises two electrical connectors 100 connected side by side, the structure of each electrical connector 100 is the same as that in the first embodiment, the terminal positioning seats 4 of the two adjacent electrical connectors 100 are integrally connected together. In the embodiment, only the two electrical connectors 100 are taken as an example for illustration, similarly, the three or more electrical connectors 100 can be connected side by side. So that a plurality of the electrical connectors 100 can be conveniently mounted together on the circuit board 8, and the plurality of the electrical connectors 100 can be closely arranged, so as to reduce an occupied space on the circuit board 8.

In conclusion, the first extension portions 23 and the second extension portions 33 are bent and extend laterally to be arranged as two rows in the front-rear direction behind the upright portion 13 of the housing 1, so as to greatly shorten the overall length of the electrical connector 100 in the front-rear direction. Furthermore, the second extension portions 33 of the second terminals 3 numbered as II and V each have the serpentine segment 331 to increase the length, so that the pair of the terminals for transmitting high-frequency signal have substantially the same lengths to reduce signal skew, which help meet the requirements for high-frequency signal transmission. In addition, by that the partition plate 421 partitions the first extension portions 23 and the second extension portions 33, the terminal positioning seat 4 can completely and reliably cover and position each first extension portion 23, each first tail portion 24, each second extension portion 33 and each second tail portion 34.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. An electrical connector, comprising:

a housing having a base and a tongue plate, the base having an upright portion, and the upright portion having a front end face and a rear end face opposite to the front end face, the tongue plate vertically extending forwardly from the front end face of the upright portion and having a first plate surface and a second plate surface at opposite two sides;

a plurality of first terminals each having a first fixed portion, a first extension portion and a first tail portion, the first fixed portions being fixed to the housing, being adjacent to the first plate surface and being arranged from top to bottom; the first extension portion of each first terminal being bent and extending laterally from a rear end of the first fixed portion, and the first tail portion extending from a distal end of the first extension portion; the first extension portions being arranged at the rear end face of the upright portion, and the first tail portions being arranged side by side along a left-right direction;

a plurality of second terminals each having a second fixed portion, a second extension portion and a second tail portion, the second fixed portions being fixed to the housing, being adjacent to the second plate surface and being arranged from top to bottom; the second extension portion of each second terminal being bent and extending laterally from a rear end of the second fixed portion, and the second tail portion extending from a distal end of the second extension portion; the second extension portions being arranged behind the first extension portions, and the second tail portions being arranged side by side along the right-left direction; and a terminal positioning seat assembled with the base of the housing and having a base portion and an assembly portion extending upwardly from the base portion, the assembly portion having a partition plate, the partition plate being positioned between the first extension portions and the second extension portions.

2. The electrical connector according to claim 1, wherein the assembly portion defines a mounting groove to be engaged with and receive the upright portion of the base, and wherein the partition plate has a slit extending along an up-down direction so as to allow the second extension portions to pass through the partition plate.

3. The electrical connector according to claim 2, wherein the base portion of the terminal positioning seat has a plurality of first through holes and a plurality of second through holes, the first through holes are positioned in front of the partition plate for correspondingly inserting and positioning the first tail portions, the second through holes are positioned behind the partition plate for correspondingly inserting and positioning the second tail portions.

4. The electrical connector according to claim 1, wherein in the first terminals, the first extension portion of at least the first terminal at the lowermost is bent and extends in the same direction as the second plate surface faces to pass through between the two adjacent second terminals and then extends downwardly, the first extension portions of the other first terminals extend in the same direction as the first plate surface faces and then extend downwardly; and in the second terminals, the second extension portion of at least the second terminal at the lowermost extends in the same direction as the second plate surface faces and then extends downwardly, the second extension portions of the other second terminals extend in the same direction as the first plate surface faces and then extend downwardly.

5. The electrical connector according to any one of claim 4, further comprising a cage, the cage surrounding the tongue plate to define a mating space, and a part of the cage being engaged with the base, and a part of the cage being engaged with the terminal positioning seat.

6. The electrical connector according to claim 5, wherein the base of the housing further has a top plate portion connected to a top end of the upright portion and extending rearwardly; the cage has two upright side plates, a top plate, a bottom plate, an upper covering plate and an upright covering plate, the upright side plates are respectively opposite to the first plate surface and the second plate surface of the tongue plate, the top plate is connected to upper ends of the upright side plates, the bottom plate is connected to lower ends of the upright side plates, the upper covering plate is connected to a rear end of the top plate and covers the top plate portion, the upright covering plate is connected to a rear end of the upper covering plate and partially covers left and right sides and rear side of the terminal positioning seat.

7. The electrical connector according to claim 6, wherein the upright side plates respectively have cutouts recessed forwardly from rear ends, and the assembly portion of the terminal positioning seat further has two protruding blocks oppositely protruding, the protruding blocks are respectively engaged with and received in the cutouts, and the base portion further has a stopper, and the bottom plate of the cage has a latch portion correspondingly latching at a rear side of the stopper.

8. The electrical connector according to claim 6, wherein the rear ends of the upright side plates respectively form step portions, the base portion of the terminal positioning seat further has a cutout recessed rearwardly from a front end, and the cutout allows the assembly portion to form a pair of flanges oppositely protruding above the cutout, the step portions respectively correspond to the flanges, and each step portion abuts against a front side and a bottom side of the corresponding flange, the base portion further has two stoppers oppositely protruding respectively from two outer sides of the base portion, and the cage further has a pair of insert pieces at the rear and respectively abutting against the rear sides of the corresponding stoppers.

9. The electrical connector according to claim 1, wherein each first terminal further has a resilient contact portion, the resilient contact portion extends from a front end of the first fixed portion and has a first contact face exposed from the first plate surface, the first tail portion extends downwardly from the distal end of the first extension portion; each second terminal further has a second contact portion, the second contact portion extends from a front end of the second fixed portion and has a second contact face exposed from the first plate surface, the second tail portion extends downwardly from the distal end of the second extension portion; the first terminals are provided as four total in number for transmitting a signal conforming to USB2.0 transmission specification, the second terminals are provided as five total in number and are cooperative with the first terminals for transmitting a signal conforming to USB3.0 transmission specification, the second terminals are numbered as I, II, III, IV and V from top to bottom; the first extension portion of the first terminal at the lowermost in the first terminals is bent and extends in the same direction as the second plate surface faces to pass through between the two second terminals numbered as IV and V and then extends downwardly, the first extension portions of the other first terminals are bent and extend in the same direction as the first plate surface faces and then extend downwardly; and the second extension portion of the second terminal numbered as V is bent and extends in the same direction as the second plate surface faces and then extends downwardly, the second extension portions of the other second terminals are bent and extend in the same direction as the first plate surface faces and then extend downwardly.

10. The electrical connector according to claim 9, wherein the second terminals numbered as I and II are provided as a pair and the second terminals numbered as IV and V are provided as another pair for transmitting a high-frequency signal, lengths of parts of the same pair of the second terminals used for transmitting the signal are the same and wherein the second extension portions of the second terminals numbered as II and V each have a serpentine segment to allow lengths of the second extension portions of the second terminals numbered as II and V to be the same and allow lengths of the second extension portions of the second terminals numbered as IV and V to be the same.

11. An electrical connector assembly, comprising at least two electrical connectors connected side by side, each electrical connector comprising:

a housing having a base and a tongue plate, the base having an upright portion, and the upright portion having a front end face and a rear end face opposite to the front end face, the tongue plate vertically extending forwardly from the front end face of the upright portion and having a first plate surface and a second plate surface at opposite two sides;

a plurality of first terminals each having a first fixed portion, a first extension portion and a first tail portion, the first fixed portions being fixed to the housing, being adjacent to the first plate surface and being arranged from top to bottom; the first extension portion of each first terminal being bent and extending laterally from a rear end of the first fixed portion, and the first tail portion extending from a distal end of the first extension portion; the first extension portions being arranged at the rear end face of the upright portion, and the first tail portions being arranged side by side along a left-right direction;

a plurality of second terminals each having a second fixed portion, a second extension portion and a second tail portion, the second fixed portions being fixed to the housing, being adjacent to the second plate surface and being arranged from top to bottom; the second extension portion of each second terminal being bent and extending laterally from a rear end of the second fixed portion, and the second tail portion extending from a distal end of the second extension portion; the second extension portions being arranged behind the first extension portions, and the second tail portions being arranged side by side along the right-left direction; and a terminal positioning seat assembled with the base of the housing and having a base portion and an assembly portion extending upwardly from the base portion, the assembly portion having a partition plate, the partition plate being positioned between the first extension portions and the second extension portions;

the terminal positioning seats of the two adjacent electrical connectors being integrally connected together.

12. The electrical connector assembly according to claim 11, wherein the assembly portion defines a mounting groove to be engaged with and receive the upright portion of the base and wherein the partition plate has a slit extending along an up-down direction so as to allow the second extension portions to pass through the partition plate.

13. The electrical connector assembly according to claim 12, wherein the base portion of the terminal positioning seat has a plurality of first through holes and a plurality of second through holes, the first through holes are positioned in front of the partition plate for correspondingly inserting and positioning the first tail portions, the second through holes are positioned behind the partition plate for correspondingly inserting and positioning the second tail portions.

14. The electrical connector assembly according to claim 11, wherein in the first terminals, the first extension portion of at least the first terminal at the lowermost is bent and extends in the same direction as the second plate surface faces to pass through between the two adjacent second terminals and then extends downwardly, the first extension portions of the other first terminals extend in the same direction as the first plate surface faces and then extend downwardly; and in the second terminals, the second extension portion of at least the second terminal at the lowermost extends in the same direction as the second plate surface faces and then extends downwardly, the second extension portions of the other second terminals extend in the same direction as the first plate surface faces and then extend downwardly.

15. The electrical connector assembly according to claim 14, further comprising a cage, the cage surrounding the tongue plate to define a mating space, and a part of the cage being engaged with the base, and a part of the cage being engaged with the terminal positioning seat.

16. The electrical connector assembly according to claim 15, wherein the base of the housing further has a top plate portion connected to a top end of the upright portion and extending rearwardly; the cage has two upright side plates, a top plate, a bottom plate, an upper covering plate and an upright covering plate, the upright side plates are respectively opposite to the first plate surface and the second plate surface of the tongue plate, the top plate is connected to upper ends of the upright side plates, the bottom plate is connected to lower ends of the upright side plates, the upper covering plate is connected to a rear end of the top plate and covers the top plate portion, the upright covering plate is connected to a rear end of the upper covering plate and partially covers left and right sides and rear side of the terminal positioning seat.

17. The electrical connector assembly according to claim 16, wherein the upright side plates respectively have cutouts recessed forwardly from rear ends, and the assembly portion of the terminal positioning seat further has two protruding blocks oppositely protruding, the protruding blocks are respectively engaged with and received in the cutouts, and the base portion further has a stopper, and the bottom plate of the cage has a latch portion correspondingly latching at a rear side of the stopper.

18. The electrical connector assembly according to claim 17, wherein the rear ends of the upright side plates respectively form step portions, the base portion of the terminal positioning seat further has a cutout recessed rearwardly from a front end, and the cutout allows the assembly portion to form a pair of flanges oppositely protruding above the cutout, the step portions respectively correspond to the flanges, and each step portion abuts against a front side and a bottom side of the corresponding flange, the base portion further has two stoppers oppositely protruding respectively from two outer sides of the base portion, and the cage further has a pair of insert pieces at the rear and respectively abutting against the rear sides of the corresponding stoppers.

19. The electrical connector assembly according to claim 11, wherein each first terminal further has a resilient contact portion, the resilient contact portion extends from a front end of the first fixed portion and has a first contact face exposed from the first plate surface, the first tail portion extends downwardly from the distal end of the first extension portion; each second terminal further has a second contact portion, the second contact portion extends from a front end of the second fixed portion and has a second contact face exposed from the first plate surface, the second tail portion extends downwardly from the distal end of the second extension portion; the first terminals are provided as four total in number for transmitting a signal conforming to USB2.0 transmission specification, the second terminals are provided as five total in number and are cooperative with the first terminals for transmitting a signal conforming to USB3.0 transmission specification, the second terminals are numbered as I, II, III, IV and V from top to bottom; the first extension portion of the first terminal at the lowermost in the first terminals is bent and extends in the same direction as the second plate surface faces to pass through between the two second terminals numbered as IV and V and then extends downwardly, the first extension portions of the other first terminals are bent and extend in the same direction as the first plate surface faces and then extend downwardly; and the second extension portion of the second terminal numbered as V is bent and extends in the same direction as the second plate surface faces and then extends downwardly, the second extension portions of the other second terminals are bent and extend in the same direction as the first plate surface faces and then extend downwardly.

20. The electrical connector assembly according to claim 19, wherein the second terminals numbered as I and II are provided as a pair and the second terminals numbered as IV and V are provided as another pair for transmitting a high-frequency signal, lengths of parts of the same pair of the second terminals used for transmitting the signal are the same and wherein the second extension portions of the second terminals numbered as II and V each have a serpentine segment to allow lengths of the second extension portions of the second terminals numbered as II and V to be the same and allow lengths of the second extension portions of the second terminals numbered as IV and V to be the same.

* * * * *